United States Patent [19]

Psaras

[11] 4,177,576

[45] Dec. 11, 1979

[54] METHOD AND APPARATUS FOR CONDITIONING MATERIAL UTILIZING AIRFLOW CONTROL MEANS

[75] Inventor: John D. Psaras, Louisville, Ky.

[73] Assignee: Brown & Williamson Tobacco Corporation, Louisville, Ky.

[21] Appl. No.: 877,154

[22] Filed: Feb. 13, 1978

Related U.S. Application Data

[62] Division of Ser. No. 705,739, Jul. 15, 1976, Pat. No. 4,091,824.

[51] Int. Cl.[2] ..... F26B 3/04

[52] U.S. Cl. ..... 34/33; 34/201; 131/136

[58] Field of Search ..... 34/31, 33, 201, 236; 131/133, 134, 135, 136, 137, 138, 140 R, 140 P

[56] References Cited

U.S. PATENT DOCUMENTS

| | | | |
|---|---|---|---|
| 3,259,995 | 7/1966 | Powischill | 34/31 |
| 3,398,467 | 8/1968 | Brown | 34/236 |
| 3,755,916 | 9/1973 | Gulaian | 34/105 |
| 4,004,594 | 1/1977 | Wochnowski | 131/136 |

*Primary Examiner*—John J. Camby

*Attorney, Agent, or Firm*—Charles G. Lamb; William J. Mason

[57] ABSTRACT

A method and preferred apparatus for conditioning materials such as tobacco using an airflow distributor means. A conveyor transports the material along a path, and means to control the conditioning of the material are located at selected locations. A source of gas produces a gas stream, and means are operatively associated with the source of gas to selectively condition the gas stream. Flow straightening means having a structure such as a honeycomb panel are positioned upstream of the material being transported on the conveyor. The gas stream source is positioned to direct the gas stream through the flow straightening means to spread the gas stream evenly across the conveyor surface for uniform conditioning of the transported material. The conditioning may include heating and/or cooling the material, introducing moisture into the gas stream, adding chemicals into the gas stream, or selected combinations of these.

17 Claims, 8 Drawing Figures

METHOD AND APPARATUS FOR CONDITIONING MATERIAL UTILIZING AIRFLOW CONTROL MEANS

This is a division of application Ser. No. 705,739 filed July 15, 1976 now U.S. Pat. No. 4,091,824.

BACKGROUND OF THE INVENTION

1. Field of the Invention

The invention relates to the conditioning of material such as tobacco wherein a gaseous medium such as air is directed onto the material. The invention has particular utility in providing for uniform drying, cooling or moisture addition with respect to the material.

2. Description of Prior Art

It is known that material such as tobacco being processed may be conditioned by heating, cooling, adding moisture content and other processing operations. The Wochnowski U.S. Pat. Nos. 3,502,085 and 3,556,111 relate to apparatus for the conditioning of tobacco wherein heated air is directed onto the tobacco during processing. Wochnowski provides a heating chamber including a plate-like sieve or distributor for the purpose of distributing heated air from the heater uniformly in all zones of the tobacco to insure uniform heating and control expulsion of nitrogen. The structure of the sieve disclosed therein is understood as comprising a plate defining a plurality of openings. Other present-day techniques in conditioning tobacco directs a heated air stream off a baffle onto a conveyor carrying the tobacco. These prior art techniques of directing the air stream produce wide variations from point to point and time to time in the airflow velocity which exists across the conveyor. The end result of these variations in airflow velocity are variations in drying.

Various devices for directing air to a particular area are known. Freeman U.S. Pat. No. 3,579,849, for example, discloses a jet tube for the purpose of expelling air vertically and keeping it away from the ends of the chamber. The purpose of the jet tube is to direct the air across a horizontal area. The Schlemmer U.S. Pat. No. 3,455,120 relates to controlling airflow utilizing a plurality of channels through which the air is directed in order to distribute the airflow. Howell U.S. Pat. No. 3,848,465 relates to an anemometer with a honeycomb structure in the airflow path. It appears that the function of the honeycomb structure in this instance is to change direction of airflow, the patent stating at Col. 4 beginning at line 15 that "the air emerges from the honeycomb with no horizontal momentum therein." Honeycomb material is also commonly used as a flow straightener in wind tunnels.

SUMMARY OF THE INVENTION

This invention relates to improved gas flow control when conditioning material such as tobacco. It solves the problem of airflow velocity variations over the conveyor and thus provides particular advantages over prior art conditioning airflow devices.

The invention specifically relates to a method and apparatus for distributing conditioned air through a flow control structure such as a honeycomb during the conditioning operation. The flow control structure has the effect of spreading the gas flow evenly across the material, providing uniform heating, cooling or moisture addition conditioning thereto. The flow control structure comprises a flow straightening structure having a plurality of parallel, similarly shaped conduits, such as a honeycomb panel, positioned upstream of the material being transported on the conveyor, and in the flow path between a source of gas producing a gas stream directed through the flow control structure towards the material. The gas may comprise air, for example, but the invention is not limited to the use of air. The air stream is utilized in various conditioning operations, such as heating, cooling and reordering of the material.

In the preferred embodiment of the invention, different conditioning operations are performed on the tobacco at particular locations and times as the tobacco is transported by the conveyor. The flow straightening means may be used in conjunction with any desired conditioning operation, and are wider than the conveyor to enable spreading of the airflow evenly across the conveyor and, therefore, the tobacco being transported. Normally, to obtain uniform drying characteristics, tobacco is dried by directing heated air to it at separate updraft and downdraft drying locations. Separate flow straightening means would therefore be positioned at the updraft and downdraft locations, and may generally be used with other conditioning operations, such as at cooling and reordering locations.

The flow straighteners installed in the heat section of an apron dryer provide increased moisture control due to improved thermal distribution. An apron dryer is a conventionally known apparatus comprised of an enclosed chamber having a conveyor means passing therethrough and having treatment zones within the chamber for acting on material carried on the conveyor. This makes it possible to dry strip at various target moistures of 3%, 6% and 9%, for example, for consumer preference studies.

It is the object of this invention to provide uniform conditioning of material by spreading gas flow evenly thereover through the use of a flow straightening structure such as a honeycomb panel.

It is another object of the invention to provide consistent airflow velocity characteristics over the conveyor through the use of the flow control device.

It is a further object of this invention to control flow of a gas stream in conditioning material by heating to minimize energy requirements.

DETAILED DESCRIPTION OF THE PREFERRED EMBODIMENT

Figure 1A:
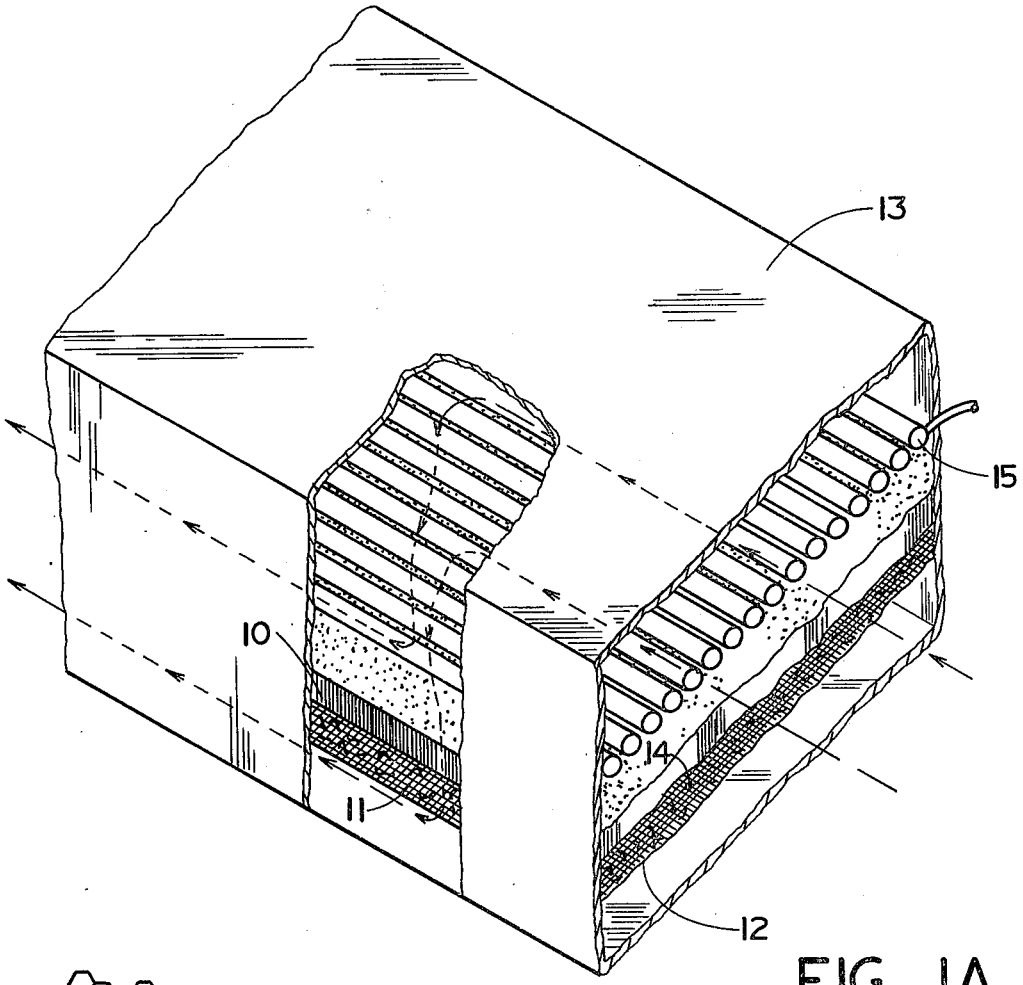
FIGS. 1(A) and 1(B) are respectively a perspective view of a preferred apparatus according to the invention utilizing a flow straightening means in a honeycomb panel configuration to spread airflow evenly across transported material such as tobacco, and a blown-up view of the honeycomb structure.

FIG. 1 generally shows a flowing straightening means in a honeycomb panel configuration 10, through which gas is directed from a source of gas 13 (not shown) through plenum. The flow of gas is indicated by the direction arrows.

The flow straightening means in accordance with the invention comprises a plurality of parallel, similarly shaped conduits having a hydraulic diameter to length ratio of from at least about 1:5 to about 1:30, and preferably at least about 1:10. Hydraulic diameter is defined as twice the surface area of the conduit divided by its perimeter. The ends of the conduits of the flow straightening means adjacent the conveyor apparatus 12 are positioned in a plane spaced from and parallel to the plane of the conveyor. The hydraulic diameter of each conduit is from about 0.05 inch to about 1 inch, and preferably is at least about 0.1 inch. Hydraulic diameters somewhat greater than about 1 inch can be employed in the present invention with some sacrifice in the desirable features.

Figure 1B:
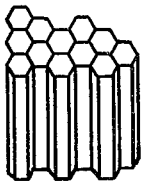

The flow straightening means 10, which is shown as comprising honeycomb cells 14, spreads the gas evenly across the bed of material, such as tobacco 11, being transported by conveying apparatus 12. The flow straightening means 10 may comprise a material such as metal or plastic having a hexagonal honeycomb structure as shown in FIG. 1(B) in which the length of the honeycombs is significantly greater than their hydraulic diameter or width. For exemplary purposes only, the honeycomb panel may comprise a 3" thick aluminum honeycomb structure with the individual honeycomb cells 14 being hexagonally configured, and the width of the cells being approximately a fourth of an inch. In this example, the ratio between honeycomb length and width would be approximately 12 to 1. The invention is not limited to this material or honeycomb ratio value, and it has been found that a honeycomb ratio value of up to 30 to 1 may be utilized in accordance with the invention.

In FIG. 1, honeycomb panel 10 is spacedly located above the tobacco bed transported by the conveyor. In accordance with the example heretofore given, the honeycomb panel 10 is spaced in the range of two (2)--three (3) inches above the tobacco bed. According to the invention, the preferred distance of the honeycomb panel from the tobacco bed is 0–50 hydraulic diameters of the honeycomb cell size. The source of gas 13 is spacedly located above honeycomb panel 10, which emits a gas stream.

The honeycombs 14 of the honeycomb panel are arranged such that their longitudinal dimension is perpendicular to the conveyor surface. The invention however is not limited to this particular arrangement, although this is the preferable alignment. The gas stream is conditioned by conditioning means 15 and flows through the honeycombs 14 and onto the bed of tobacco. Experiments have shown that the gas stream spreads evenly over the surface of the bed of tobacco, producing similar airflow velocity characteristics at different points of the surface. This results in uniform conditioning of the bed of tobacco.

The conditioning means 15 are commonly known in the art and therefore are not explained in detail herein. The conditioning means alter the physical or chemical state of the tobacco. Depending on the stage of tobacco processing, they may comprise means to heat, cool or reorder the gas emitted from the gas source. The gas may comprise air but other gases are also contemplated for use in the invention, and flows as indicated across the conditioning means 15, through the honeycomb panel 10, onto the tobacco bed 11, and is exhausted through the bottom of plenum 13, through exhaust means such as a fan.

Figure 2:
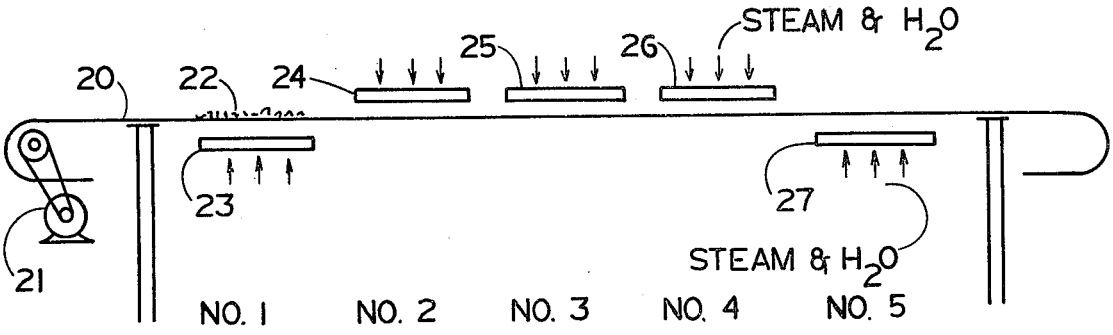
FIG. 2 illustrates a system in which a plurality of honeycomb panels are arranged at different tobacco conditioning locations along the conveyor path.

FIG. 2 shows the manner in which the gas control apparatus including honeycomb panels may be utilized in a tobacco conditioning process. Conveyor 20 is translated by appropriate means such as motor 21. The bed of tobacco 22 to be conditioned is located on the conveyor and is transported to successive locations for the desired conditioning. Five conditioning locations are shown in FIG. 2. The first and second locations are heating locations at which gas such as air is heated and directed to the tobacco for drying the tobacco. Individual honeycomb panels 23 and 24 are shown located on opposite sides of conveyor 20. These honeycomb panels function as discussed above with respect to FIG. 1. Process location 1 is the updraft heating location with heated air being directed to the underside of the bed of tobacco, and location 2 is the downdraft heating location with heated air being directed to the top of the bed of tobacco. This insures uniform drying of the tobacco.

The tobacco is cooled at location 3 by appropriately cooling the air emitted by the source of air. A honeycomb panel 25 is interposed between the source of air and the bed of tobacco. Locations 4 and 5 are reorder positions at which steam and water are respectively the downdraft and updraft reordering locations. Individual honeycomb panels 26 and 27 are respectively interposed in the airstreams at locations 4 and 5.

In accordance with a working example of the invention, the honeycomb structure comprises panels of ¼" width hexagonal cells, 3" thick, and covers the entire heat sections of the tobacco bed. The use of these panels allows the hot air to flow uniformly through the tobacco bed. This results in uniform and reproducible drying at the desired target moisture levels with a much narrower range than had been experienced previously with prior art devices. The range of moistures experienced during tobacco drying compared to prior art devices is significantly reduced. Through the more efficient use of dryer heat capacity in accordance with the invention, lower target moistures are obtained.

Figure 3:
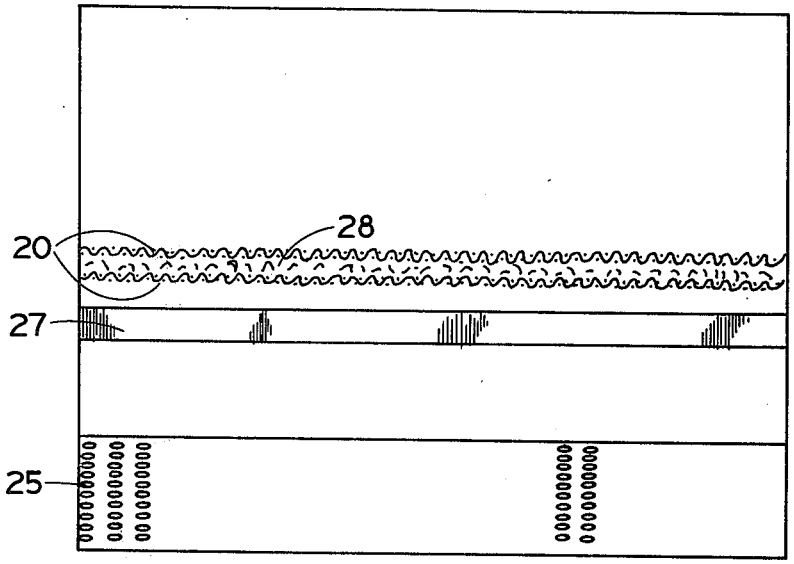
FIG. 3 is a side view of part of an apron dryer used in practicing the invention in accordance with a working example thereof.
Figure 4A:
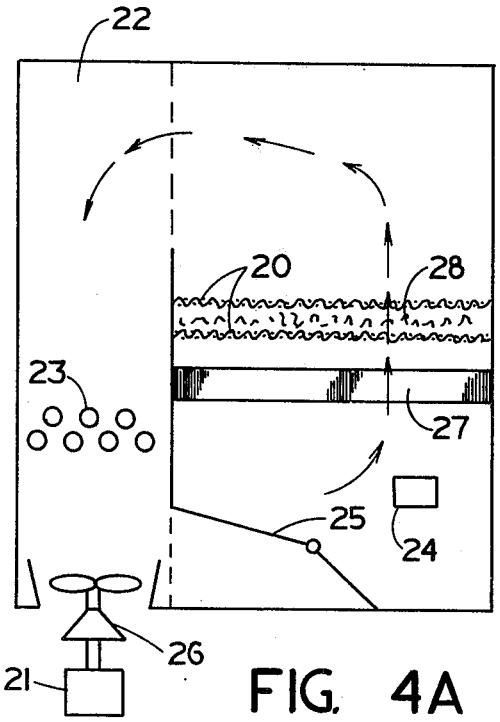
FIGS. 4(A) and 4(B) respectively are cross-section views of the updraft and downdraft sections of apron dryer of FIG. 3.
Figure 4B:
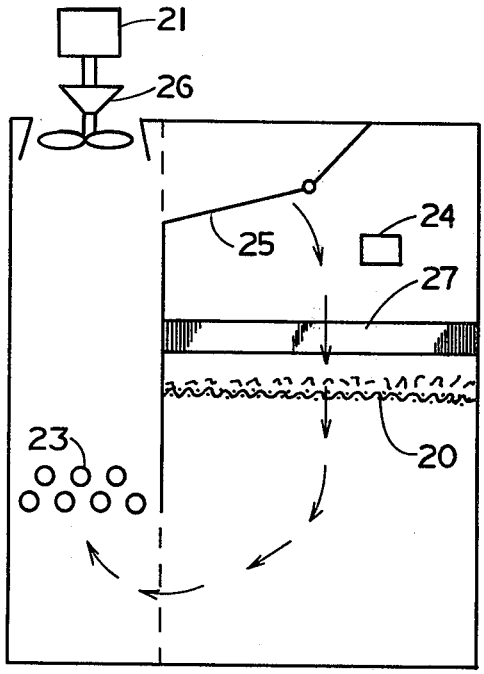

In the working example of the invention, an apron dryer was used, comprising two heating sections, one cooling section and two reordering sections, in that order. With reference to FIGS. 3, 4(A) and 4(B), the apron 20 width may, for example, be 48 inches with the first heat section being 82 inches long, followed by a 40-inch long second section. Each heating section has an exhaust air fan 21 in a plenum chamber 22 circulating air through the apron. The air is heated as it passes over a steam heat exchanger 23 located in the plenum and its temperature sensed by a probe and pneumatic controller 24 located inside the apron chamber. The air temperature above and below the apron is continuously recorded with a recorder (not shown).

Some air is exhausted to the roof through a common exhaust ductwork (not shown) to the two heat sections and the two reorder sections. The quantity of air exhausted through each section can be regulated by means of a baffle. Make-up air from the surrounding area is brought into the heat sections by opening louvers (not shown) located on the plenum chamber wall. The overall velocity, air volume, and static pressure in each heat section can be regulated by relocating a baffle 26 on the fan shaft.

Air enters the main chamber from the plenum and is distributed by means of an inclined perforated plate 25 extending about halfway through the width of each chamber. In the first heat section shown in FIG. 4(A), air is circulated such that it is directed toward the bottom of the apron (updraft). To avoid blowing away tobacco from the apron bed, a "hold down" apron 28 which may comprise a wire grid is located on top of the main apron extends through the first heat section only. In the second heat section as shown in FIG. 4(B), air is circulated such that it is directed toward the top of the apron (downdraft). The tobacco apron construction is of stainless steel mesh and the apron travels at a speed of 15 inches per minute, for example, through the dryer. This speed was maintained throughout the evaluation that follows.

An aluminum honeycomb flow distributor panel 27 is located upstream of the two heat sections and covers the entire apron width. The honeycomb structure may be a three-inch thick panel of ¼ inch cell construction of 0.004 inches thick annealed aluminum foil. The honeycomb flow distribution functions to alter the direction of air flow, minimize free air turbulence, attain laminar uniform velocity profiles, and minimize pressure drop. Upon installation of the honeycomb panels, the velocity profiles between the honeycomb panels and apron were measured and found to be flat.

Figure 5:
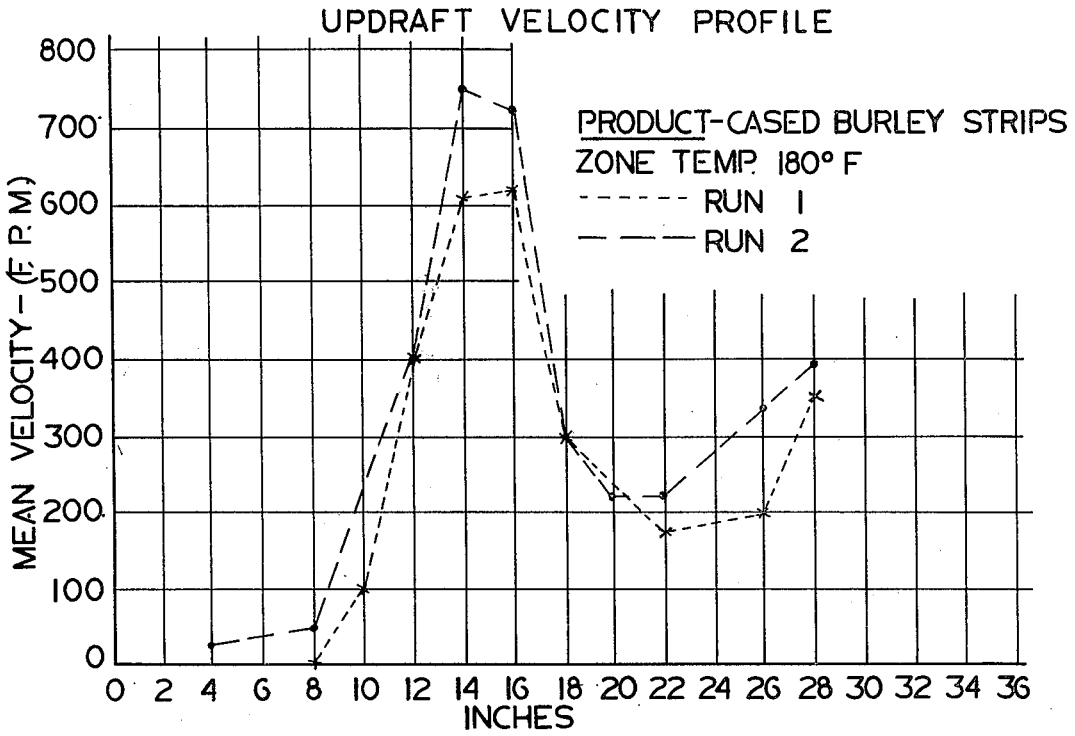
FIGS. 5 and 6 respectively are graphs of time dependent velocity profiles typically obtained in the updraft and downdraft heat sections of an apron dryer not having honeycomb panels.
Figure 6:
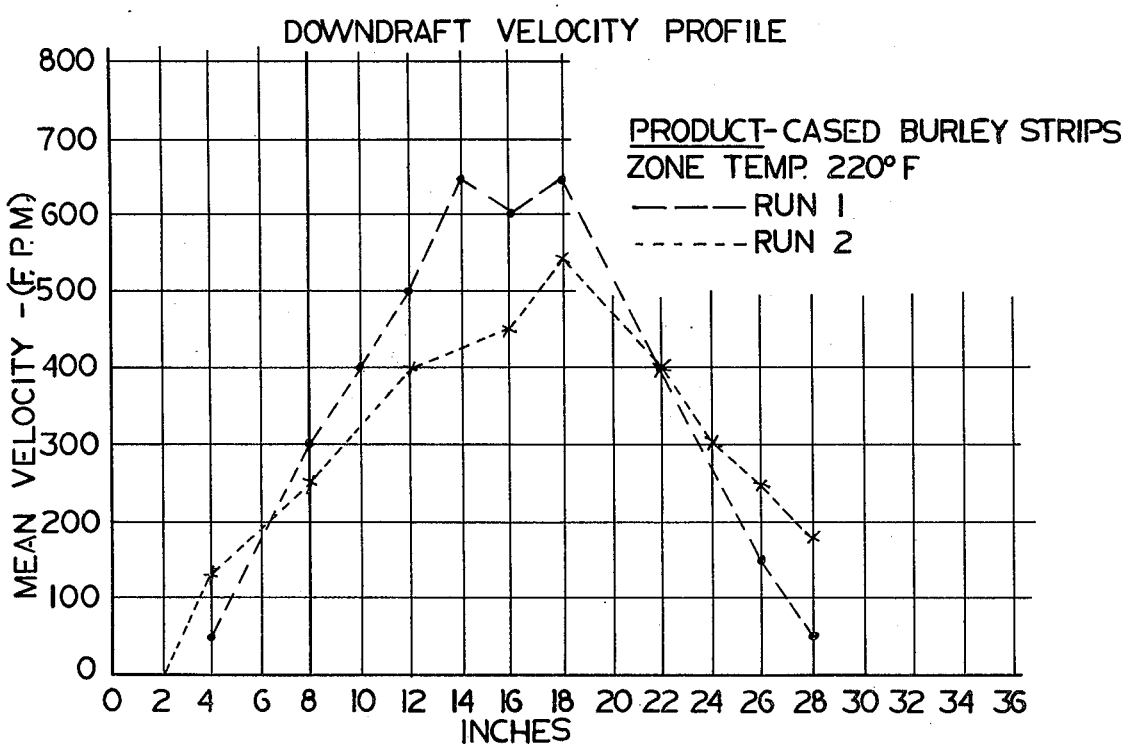

In contradistinction, FIGS. 5 and 6 illustrate time dependent velocity profiles typically obtained in the updraft and downdraft heat sections of an apron dryer of the type shown in FIGS. 3 and 4, but not having honeycomb panels. The plotted mean velocity profiles (FIG. 5) in the first heat section are substantially consistent between runs 1 and 2. They exhibit a maximum velocity at 14–16 inches from the apron front, and a minimum velocity at 20–26 inches from the apron front. The plotted mean velocity profiles (FIG. 6) in the second heat section were also consistent between runs 1 and 2. They exhibit a maximum velocity at 14–22 inches from the apron front. The velocity profile distribution for both heat sections is attributed to the perforated baffle design configuration in the two zones, which directs air towards the front of the apron and away from plenum. The net result of distorted velocity profiles in the two heat sections is an uneven heat capacity distribution through the tobacco apron which gives rise to uneven drying of the tobacco.

In the first heat section, the velocity profile was modified to an even 75 fpm and 50 fpm in the second heat section. The Reynolds number is maximum in the first heat section and at $2.4\times10^2$ between the honeycomb panel and the apron, laminar flow clearly prevailed. This is attained at the expense of a very small pressure drop, on the order of $1.48\times10^{-5}$ p.s.i. Also, the moisture of the tobacco exiting the cooling sections was reduced as was the moisture range.

As can be seen from the following results, the better utilization of the air heat capacity results in more efficient drying (3.15% vs. 4.5% mean moisture) to the effect of an additional loss of 0.0124 pounds of moisture per pound of tobacco. In the following tables, $\bar{x}$=statistical mean value, $\delta$=standard deviation, N=number of samples, and "Range"=the difference between the two extreme values measured.

| CONDITION | TEMPERATURE SETTING 1st HEAT SECTION | TEMPERATURE SETTING 2nd HEAT SECTION | MOISTURES % EXIT COOLING SECTION $\bar{x}$ | $\delta$ | N | Range |
|---|---|---|---|---|---|---|
| No honeycomb | 220° F. | 180° F. | 4.5 | 1.76 | 36 | 1.0–10.1 |
| With honeycomb | 220° F. | 180° F. | 3.15 | 0.47 | 68 | 2.0–4.6 |

Further reductions in heat zone temperature settings gave the desired 6% and 9% moisture levels exit cooling section. As an example, a characteristic test with honeycomb yielded the data:

| TARGET MOISTURE EXIT COOLING SECTION | TEMPERATURE SETTINGS 1st HEAT SECTION | TEMPERATURE SETTINGS 2nd HEAT SECTION | ACTUAL MOISTURES % $\bar{x}$ | $\delta$ | N |
|---|---|---|---|---|---|
| 6% | 200° F. | 160° F. | 5.44 | 1.95 | 30 |
| 9% | 175° F. | 160° F. | 8.7 | 2.0 | 30 |

The flow straightening means provides a significant reduction in moisture range with reproducible target moistures obtained at lower heat section temperature settings. This results in a reduction in energy consumption and incident monetary savings.

While the foregoing description has been presented primarily in terms of a flow straightener means having the preferred honeycomb panel, e.g., a panel comprised of a plurality of adjacent, parallel conduits having a hexagonal cross-section, it is to be appreciated that panels formed of conduits having other cross-sectional configurations may be employed. Exemplary alternative cross-sections include square, diamond-shaped and triangular configurations.

Although the invention has been described with reference to the treatment of tobacco, the conditioning apparatus and method of the invention clearly may be used in treating other types of bulk fibrous materials such as foods and the like. It will be apparent to those skilled in the art that various modifications and variations could be made in the gas flow apparatus and method of the invention without departing from the scope or spirit of the invention.

I claim:

1. In an apparatus for use in conditioning material including a conveyor device to transport the material on its surface along a path for conditioning the material at selected times and locations, the improvement comprising:

a source of gas to produce a gas stream, means operatively associated with the source of gas to selectively condition the gas stream, panel means for delivering a laminar flow of gas to the material having a honeycomb structure positioned in spaced relation to, upstream of, and coextensive with the conveyor surface supporting said material, said spaced relation between said honeycomb structure and said material being from 0 to 50 hydraulic diameters of the honeycomb cell size in said honeycomb structure, and, means to direct the gas stream through the honeycombs of the panel means to thereby spread the gas stream evenly across the conveyor for uniform conditioning of the transported material.

2. The apparatus recited in claim 1 wherein the panel means are positioned such that the longitudinal dimension of the honeycombs is substantially perpendicular to the conveyor.

3. The apparatus recited in claim 2 wherein the panel means is substantially coextensive with the conveyor device in the direction transverse to the direction of travel of the conveyor device.

4. The apparatus as recited in claim 3 wherein the means to condition are operative to remove heat from the material.

5. The apparatus as recited in claim 3 wherein the means to condition are operative to introduce moisture into the material.

6. The apparatus as recited in claim 3 wherein the means to condition are operative to introduce selected materials into the material.

7. In an apparatus for use in conditioning material including a conveyor device to transport the material on its surface along a path for conditioning the material at selected times and locations, the improvement comprising:

a source of gas to produce a gas stream, means operatively associated with the source of gas to selectively condition the gas stream, flow straightening means having a plurality of parallel, similarly shaped conduits having a hydraulic diameter to length ratio in the range of 1:5 to 1:30 positioned in spaced relation to and upstream of the conveyor surface supporting said material, said straightening means being coextensive with said conveyor and the spaced relation between said straightening means and said material being from 0 to 50 hydraulic diameters of the conduit size in the straightening means, and, means to direct the gas stream through the flow straightening means to thereby spread the gas stream evenly across the conveyor for uniform conditioning of the transported material.

8. The apparatus recited in claim 7 wherein the flow straightening means are positioned in a plane spaced from and parallel to the plane of the conveyor.

9. The apparatus recited in claim 8 wherein the flow straightening means is substantially coextensive with the conveyor device in the direction transverse to the direction of travel of the conveyor device.

10. The apparatus as recited in claim 9 wherein the means to condition are operative to remove heat from the material.

11. The apparatus as recited in claim 9 wherein the means to condition are operative to introduce material into the material.

12. The apparatus as recited in claim 9 wherein the means to condition are operative to introduce selected materials into the material.

13. The apparatus recited in claim 7 wherein the hydraulic diameter to length ration of the conduits is at least 1:10.

14. The apparatus recited in claim 7 wherein the hydraulic diameter of each conduit is in the range of 0.05 to 1.0 inch.

15. The apparatus recited in claim 7 wherein the hydraulic diameter of each conduit is at least 0.1 inches.

16. A method of conditioning material comprising:

transporting the material on a conveyor along a path, and directing a stream of conditioned gas at the material through a flow straightening structure comprising a plurality of parallel, similarly shaped conduits, each having a hydraulic diameter in the range of 0.05 to 1.0 inches and a hydraulic diameter to length ratio in the range of 1:5 to 1:30, said flow straightening means being coextensive with said conveyor, to spread the gas stream evenly across the surface of the conveyor for uniform conditioning of the material.

17. A method of conditioning material comprising:

transporting the material on a conveyor along a path, and directing a stream of conditioned gas at the material through a honeycomb structure coextensive with said conveyor to spread the gas stream evenly across the surface of the conveyor for uniform conditioning of the material.

* * * * *

UNITED STATES PATENT AND TRADEMARK OFFICE

CERTIFICATE OF CORRECTION

PATENT NO. : 4,177,576

DATED : December 11, 1979

INVENTOR(S) : John D. Psaras

It is certified that error appears in the above-identified patent and that said Letters Patent are hereby corrected as shown below:

Column 8, claim 11, line 2, correct "material" to --moisture--.

Signed and Sealed this

*Twentieth* Day of *May 1980*

[SEAL]

*Attest:*

SIDNEY A. DIAMOND

*Attesting Officer*

*Commissioner of Patents and Trademarks*